US007828453B2

(12) United States Patent
Tran et al.

(10) Patent No.: US 7,828,453 B2
(45) Date of Patent: Nov. 9, 2010

(54) LIGHT EMITTING DEVICE AND LAMP-COVER STRUCTURE CONTAINING LUMINESCENT MATERIAL

(75) Inventors: Nguyen The Tran, Garden Grove, CA (US); Yongzhi He, Irvine, CA (US); Frank Shi, Irvine, CA (US)

(73) Assignee: Nepes LED Corporation, Cheongwon-Gu, Chungcheongbuk-Do (KR)

( * ) Notice: Subject to any disclaimer, the term of this patent is extended or adjusted under 35 U.S.C. 154(b) by 0 days.

(21) Appl. No.: 12/462,348

(22) Filed: Aug. 3, 2009

(65) Prior Publication Data

US 2010/0232134 A1 Sep. 16, 2010

Related U.S. Application Data

(63) Continuation of application No. 12/381,407, filed on Mar. 10, 2009.

(51) Int. Cl.
*F21V 9/16* (2006.01)
*F21V 5/04* (2006.01)

(52) U.S. Cl. ..... 362/84; 362/268; 362/331; 362/329; 362/336

(58) Field of Classification Search ..... 362/84, 362/231, 268, 331, 311.02, 311.06, 311.1, 362/318, 335, 336, 329
See application file for complete search history.

(56) References Cited

U.S. PATENT DOCUMENTS

| | | | | |
|---|---|---|---|---|
| 5,506,762 | A * | 4/1996 | Ziegler et al. | 362/202 |
| 6,655,810 | B2 * | 12/2003 | Hayashi et al. | 362/600 |
| 7,582,914 | B2 * | 9/2009 | Lin | 257/98 |
| 2007/0241357 | A1 * | 10/2007 | Yan | 257/98 |
| 2008/0048200 | A1 * | 2/2008 | Mueller et al. | 257/98 |
| 2008/0094829 | A1 * | 4/2008 | Narendran et al. | 362/231 |
| 2009/0052158 | A1 * | 2/2009 | Bierhuizen et al. | 362/84 |

* cited by examiner

*Primary Examiner*—Stephen F Husar
*Assistant Examiner*—Peggy A. Neils
(74) *Attorney, Agent, or Firm*—Jason Y. Pahng

(57) ABSTRACT

An LED lamp cover structure containing luminescent material, its fabrication methods, and an LED package using the LED lamp cover are disclosed. The LED lamp cover is comprised of a first lens cap providing the outer surface of the lamp cover, a second lens cap providing the inner surface of the lamp cover, and an encapsulating layer sandwiched between the first and second lens caps. The lamp cover of the invention covering a color LED package such as blue color can provide white light output.

14 Claims, 1 Drawing Sheet

LIGHT EMITTING DEVICE AND LAMP-COVER STRUCTURE CONTAINING LUMINESCENT MATERIAL

BACKGROUND OF INVENTION

1. Field of the Invention

This invention discloses an LED (light emitting diode) device, an LED lamp cover structure containing luminescent material, and the method of making LED lamp cover.

2. Background Art

Each LED device can emit a different color of light, and for producing white light, various colors can be combined. A conventional method for producing white light is to use luminescent materials, for example, phosphor materials that at least partially absorb blue LED-emanated light and emit yellow or greenish yellow light. In conventional phosphor-based white LED package, phosphor material is mixed with silicone encapsulation material and dispended in the cup or coated on the LED chip. These methods of applying phosphor luminescent material results in high light loss due to backwardly propagation of phosphor-emitted light into LED chip. This conventional phosphor-based white LED is suffered at higher absorption loss at light output with low correlated color temperature (CCT) such as neutral and warm white light due to high phosphor concentration that increases light trapping factor and increases backward propagation light, and due to higher backward-emitted light by phosphor materials.

An improving method is to separate the phosphor containing layer from the LED die by using a transparent spacer, such as a silicone, to reduce the chance of the phosphor-emitted and phosphor-scattered light entering or reentering the LED chip or the substrate area around the LED chip. This method is disclosed by Lowery in U.S. Pat. No. 5,959,316 and Noguchi et. al., in U.S. Pat. No. 6,858,456. The phosphor layer disclosed by Lowery and Noguchi is a distance from LED chip and is separated from LED chip by a clear encapsulation material. This method can reduce backwardly propagation light entering the LED chip and being trapped there. However, this method does not effectively block backwardly propagation light reaching high absorptive materials such as LED chip because of continuity of material with approximately same reflective index that allows the phosphor-emitted and phosphor-scattered light freely entering the clear layer below the phosphor layer. In US Pat. No. 2005/0239227, Aanegola et. al. discloses an LED package with an air gap between a blue LED package and phosphor layer coated on an inner surface of a separate structure (discrete phosphor-containing structure). Although the phosphor-containing structure separated from the LED package by an air gap can offer a better blocking of light propagating toward the LED package substrate or cup and into LED chip, the LED package using this concept might have light output lower than an LED package with integrated phosphor layer such as the package disclosed by Lowery in U.S. Pat. No. 5,959,316 if the air gap is not optimized. This is because the LED package with a simple discrete phosphor-containing structure can only prevent a portion of light propagating backwardly in backward direction while the amount of excitation light reaching the discrete phosphor layer is less than the integrated-phosphor layer. The lower amount of blue excitation light alleviates or counterbalances the advantage of light blocking improvement in the LED package with a discrete phosphor-containing structure. With a discrete phosphor-containing layer, there is about 40% of light emitted through a bottom surface, according to literature reports such as by Narendran et. al. in his paper published on *Phys. Stat. solidi* (*a*) 202 (6), R60-R62, 2005. It means even with an air gap, there is up to 40% of light emitting toward an LED package. This percentage is higher for light output with a lower correlated color temperature (CCT). Therefore, a simple discrete phosphor-containing layer might not significantly improve light output. A method to further blocking this backward propagation light is required. The LED package disclosed in US Pat. No. 2005/0239227 does not provide a method of blocking this amount of backward propagation light. Moreover, coating phosphor materials on a concave surface as disclosed in Aanegola et. al., US Pat. No. 2005/0239227 might cause non-uniform distribution of phosphor materials because of gravity force that causes coating materials flowing to the center of the phosphor-containing structure.

SUMMARY OF INVENTION

The present invention relates to an LED lamp cover containing luminescent material for providing different colors of light as well as white light and the method of making the same. The LED lamp cover is comprised of a first lens cap providing the outer surface of the lamp cover, a second lens cap providing the inner surface of the lamp cover, and a wavelength-conversion layer sandwiched between the first lens cap and the second lens cap. The wavelength-conversion layer is made of a luminescent-silicone mixture that is a mixture of silicone material and luminescent material for wavelength conversion.

The wavelength-conversion layer is formed by dispensing a luminescent-silicone mixture into the cavity of the first lens cap followed by placing the second lens cap into the cavity containing the luminescent-silicone mixture. The entire unit is then placed in a heat chamber at an appropriate temperature so that the luminescent-silicone mixture is cured and bonded to the lens caps.

The lamp cover structure is configured so that it can effectively block backward propagation light.

The LED lamp cover is combined with at least one blue LED to generate different colors of light, including white light.

DETAILED DESCRIPTION OF THE INVENTION

This invention discloses the LED lamp cover structure containing luminescent material and the method of making the LED lamp cover structure. The LED lamp cover is combined with at least one color LED package such as blue LED to generate white light or light at different colors.

Figure 1:
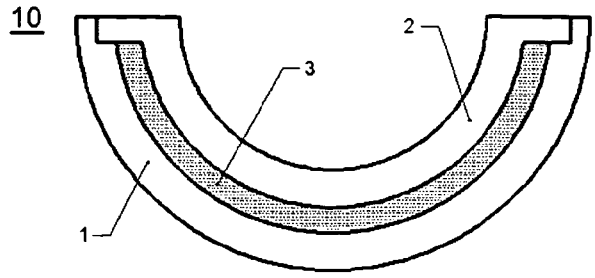
FIG. 1 is a schematic drawing of a cross-sectional view of the LED lamp cover as an example to illustrating the invention.

As shown in FIG. 1, the LED lamp cover 10 is comprised of a first lens cap 1 providing the outer surface of the lamp cover 10, a second lens cap 2 providing the inner surface of the lamp cover 10, and a wavelength-conversion layer 3 containing luminescent material for wavelength conversion and being sandwiched between the lens cap 1 and the lens cap 2. The shape and geometries of the wavelength conversion layer are based on the dimensions of the two lens caps.

The lens cap 1 and the lens cap 2 have concave-convex shapes as shown in FIG. 1 and have a circular base resulting in a shape like a portion of spherical shell. The lens cap 1 and the lens cap 2 can also have other base shapes such as rectangular or square forming a portion of cylindrical or rectangular or square shell.

The lens cap 1 and the lens cap 2 are made of a transparent material such as silicone, PMMA (poly(methyl methacrylate)), glass, and polycarbonate. The wavelength-conversion layer is made of a luminescent-silicone mixture that is a mixture of silicone material and luminescent material for wavelength conversion.

The luminescent material in the lamp cover contains at least one of blue, green, yellow, orange, and red phosphors. Green, yellow, orange, and red phosphors at least partially absorb blue wavelength of light or completely absorb UV wavelength of light, followed by emission of light spectrum with peak wavelength at green, yellow, orange, and red color regions, respectively. Blue phosphor absorbs UV wavelength of light, followed by emission of light spectrum with peak wavelength at blue color region.

The first lens cap, the second lens cap, and the gap between the first lens cap and the second lens cap can have other different shapes such as a portion of square, rectangular, and cylindrical shells.

Figure 2:
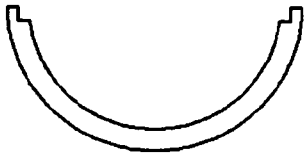
FIGS. 2*a-d* illustrate the method of making the LED lamp cover of the invention.
Figure 2:
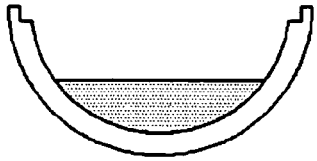
Figure 2:
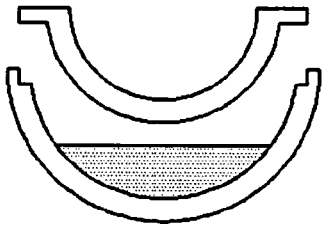
Figure 2:
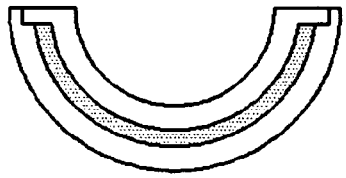

The LED lamp cover 10 is fabricated as follows: 1) providing the first lens cap 1 with a concave surface and a convex surface (FIG. 2*a*); 2) dispensing a proper amount of a luminescent-silicone mixture into the concave area of the first lens cap 1 to form the wavelength conversion layer 3 later (FIG. 2*b*); 3) placing the second lens cap 2 into the concave area of the first lens cap 1 containing the luminescent-silicone mixture so that the wavelength conversion layer 3 is sandwiched between the concave surface of the first lens cap 1 and the convex surface of the second lens cap 2 (FIGS. 2*c*-*d*); 4) curing the luminescent-silicone mixture by using heating or UV radiation.

Alternatively, the LED lamp cover 10 is fabricated as follows: 1) the first lens cap 1 with a concave surface and a convex surface is provided (FIG. 2*a*); 2) the second lens cap 2 is provided and placed into the concave area of the first lens cap 1 with an air space sandwiched between the concave surface of the first lens cap 1 and the convex surface of the second lens cap 2; 3) the second lens cap 2 is mechanically fixed to the first lens cap 1 by a mechanical design or using glue; 4) a proper amount of a luminescent-silicone mixture is dispensed into the air space to fill the air space; 5) the luminescent-silicone mixture is cured by using heating or UV radiation to form the wavelength conversion layer 3.

By providing the outer lens cap 1 and the inner lens cap 2 with a predefined space between these two lens caps, phosphor layer can be made with a uniform thickness or with a predefined structure. Therefore, there is CCT consistency among the LED devices using the lamp cover of invention, resulting in high manufacturing yield. The sandwiching structure of the lamp cover, in which phosphor layer is sandwiched between the outer lens cap 1 and the inner lens cap 2, can also prevent moisture penetrating into the phosphor layer. Thus, it can improve lifetime of the lamp cover.

The lamp cover can be used to cover a light emitting device emitting light at an excitation wavelength for luminescent material. In such a case, the luminescent material fluoresces at the excitation wavelength, such that when combined with the residue excitation light from the light emitting device, a white light can be produced. For example, the light emitting device is a blue LED with an emitting wavelength ranging from 450 nm to 480 nm, while the luminescent material emits a yellow peaked wavelength under the excitation of the blue light, such that the yellow light combined with the residue blue light creates white light. It is also possible that the luminescent material fluoresces with multiple excited wavelengths at the excitation wavelength, such that when all the excited emissions with multiple wavelengths are mixed together, a white light is produced. For example, the light emitting device is a near-UV LED with an emitting wavelength ranging from 380 nm to 450 nm, while the luminescent material emits at blue (B), green (G), and red (R) peaked wavelength under the excitation of the near-UV light, such that the RGB light mixed together creates a white light.

Figure 3:
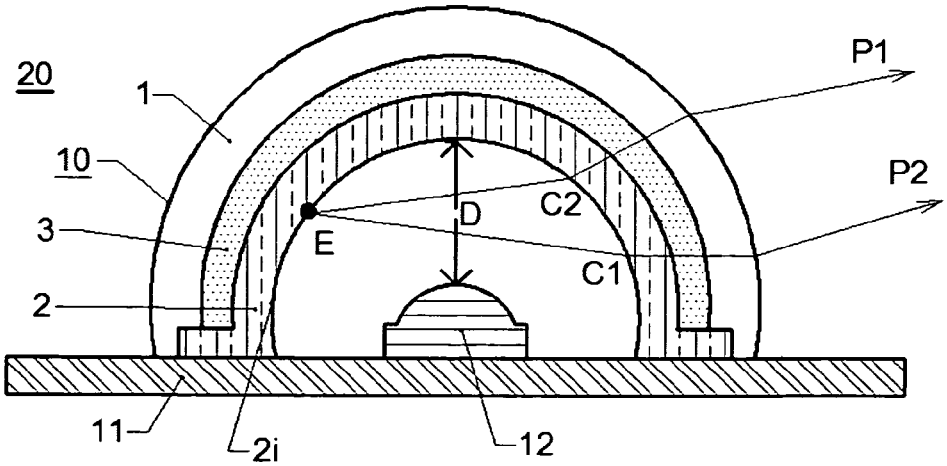
FIG. 3 is a schematic drawing of a cross-sectional view of the LED lamp using the LED lamp cover of the invention.

FIG. 3 shows an LED lamp 20 using the lamp cover 10 of the invention. The LED lamp 20 as shown in FIG. 3 consists of a printed circuit board (PCB) 11, at least one color LED package 12 that is bonded on the PCB, and the luminescent-containing lamp cover 10 that is attached to the PCB. The color LED package 12 emits blue peaked-wavelength of light that excites luminescent materials of the lamp cover 10 so that the combination of light emitted by luminescent materials and blue LED-emitted light provides white light. The LED package 12 can also emit UV light.

Preventing the entering of light emitting from the lamp cover into the color LED package 12 is critical to improve light output or efficiency of the LED lamp 20. In order to do so, the lamp cover should be configured in such a way that light emitting from the inner surface 2*i* of the lamp cover 10 is recaptured by the lamp cover 10 immediately after light emits from the inner surface 2*i* of the lamp cover. An important parameter to achieve this objective is the air gap D between the color LED package 12 and the lamp cover 10. As the gap D increases, the ratio of the inner surface 2*i* area of the lamp cover 10 to the surface area of the color LED package 12 becomes larger. The increase of this surface ratio reduces the chance that backward light enters the color LED package 12 because the solid angle subtended by the color LED package at any point on the lamp cover 10 is smaller. This concept can be clearly seen as an observation point is moved far away from an object. As the observation point is moved farther, the object is seen to be smaller. More importantly, a larger gap D increases the recapture probability of light emitted at the inner surface of the lamp cover 10 by this surface immediately after light is emitted from this surface. In order to recapture the back emitted light, the inner surface 2*i* of the lamp cover 10 must have different curvatures or different normal vector planes. It is preferred that the normal vector planes of the inner surface 2*i* converge toward the LED package 12. Examples of recapture function of the lamp cover 10 are shown in FIG. 3 with light paths P1 and P2. Light P1 and light P2 that are emitted from the point E on the inner surface 2*i* are immediately recaptured by the lamp cover 10 at the points C1 and C2 on the inner surface 2*i*, instead of entering the color LED package 12. The recapture function of the lamp cover 10 reduces absorption loss of light by the color LED package 12, and it thus improves the light output of the LED lamp 20. The gap D is chosen at a value that provides the ratio of the inner surface 2*i* area of the lamp cover 10 to the surface area of the color LED package 12 at least equal 2 or the gap D is at least 3 mm, whichever number is larger, to reduce phosphor-emitted light entering the color LED package 12 where this light is absorbed.

Increasing the gap D also increases reliability and lifetime of the LED lamp 20. Reliability and lifetime of the lamp cover 10 depends on the surface area of the lamp cover per optical output power of the LED package 12. An increase in the gap D leads to an increase in the surface area of the lamp cover 10. A larger surface area of the lamp cover provides faster heat transfer out of the lamp cover. In order to sustain in severe environment or severe testing condition such as high temperature and high humidity, the outer surface area of the lamp cover 10 per watt of optical output from the LED package 12 should be as high as possible. The outer surface area of the lamp cover 10 should be 300 $mm^2$ per watt of optical output from the LED package 12.

In contrast to conventional LED package with its efficiency being sensitive to phosphor concentration or CCT, the efficiency of the LED lamp 20 of the invention is relatively insensitive to CCT. This means the efficiency of warm and neutral light LED packages using the invented lamp cover is as high as that of cool white LED package while the conventional phosphor LED package with warm white light has light efficiency much lower than cool white LED package and lower than neutral white LED package.

What is claimed is:

1. A lamp cover structure, comprising:

a first lens cap providing the outer surface of said lamp cover structure and a cavity at the inner surface;

a second lens cap providing the inner surface of said lamp cover structure; and a wavelength-conversion layer sandwiched between said first lens cap and said second lens cap, wherein the inner surface of said lamp cover structure has different curvatures or different normal vector planes thereon such that the light emitted from a point on the inner surface of said lamp cover structure is recaptured by said lamp cover structure at other points on the inner surface of said lamp cover structure.

2. A lamp cover structure of claim 1, wherein said first lens cap and second lens cap have mechanical supporters to hold them together and provide a space between them;

said first and second lens caps are made from a transparent material; and said first and second lens caps have concave-convex shape.

3. A lamp cover structure of claim 1, wherein said first and second lens caps have one of cylindrical, square, and rectangular shell shapes.

4. A lamp cover structure of claim 1, wherein its fabrication method is as follows:

a. said first lens cap and the said second lens cap are made by using injection molding;

b. a proper amount of a silicone encapsulating material mixed with luminescent material is dispensed into the cavity of the said first lens cap;

c. said second lens cap is mechanically fitted into the said first lens cap by using mechanical holder;

d. said silicone encapsulating material is solidified by heating or UV radiation to form the said wavelength-conversion layer.

5. A lamp cover structure of claim 1, wherein its fabrication method is as follows:

a. said first lens cap and the said second lens cap are made by using injection molding;

b. said second lens cap is mechanically fitted into the said first lens cap by using mechanical supporters designed on the said two caps and a fast-curing adhesive to form a space between the two said lens caps;

c. a silicone encapsulating material mixed with luminescent material is dispensed into the space until it completely fills the space;

d. said silicone encapsulating material is solidified by heating or UV radiation to form the said wavelength-conversion layer.

6. An LED device, comprising:

said lamp cover structure of claim 1;

at least one LED package covered by the said lamp cover structure and providing excitation light for said lamp cover structure; and a substrate on which the at least one LED package is bonded and said lamp cover structure is attached.

7. An LED device of claim 6, wherein said lamp cover structure at least partially absorbs the excitation light and emits white light.

8. An LED device of claim 6, wherein said lamp cover structure has an outer surface area of at least 300 $mm^2$ per watt of the excitation light in order to increase reliability and life time of the LED device;

the gap between the LED package and said lamp cover structure is at least 3 mm in order to reduce light entering the LED package; and the ratio of the inner surface of said lamp cover structure to the surface of the LED package is equal to 2 so that said lamp cover structure can effectively recapture backwardly emitted light immediately after the light is emitted from the inner surface of said lamp cover structure.

9. A lamp cover structure of claim 1, wherein the wavelength-conversion layer comprises a silicone encapsulating material mixed with luminescent material.

10. A lamp cover structure of claim 9, wherein the luminescent material comprises at least one phosphor which is excited by an excitation light and emits visible light.

11. A lamp cover structure of claim 10, wherein the at least one phosphor emits visible light having different wavelengths when being excited by the excitation light.

12. A lamp cover structure of claim 10, wherein the excitation light comprises one of UV light, blue light and green light.

13. An LED device of claim 6, wherein the substrate is a printed circuit board.

14. An LED device, comprising:

a lamp cover structure including a first lens cap providing the outer surface of said lamp cover structure and a cavity at the inner surface, a second lens cap providing the inner surface of said lamp cover structure, and a wavelength-conversion layer sandwiched between the said first lens cap and the said second lens cap;

at least one LED package covered by said lamp cover structure and providing excitation light for said lamp cover structure; and a substrate on which the at least one LED package is bonded and said lamp cover structure is attached, wherein the inner surface of said lamp cover structure has different curvatures or different normal vector planes thereon such that light emitted from a point on the inner surface of said lamp cover structure is recaptured by said lamp cover structure at other points on the inner surface of said lamp cover structure, wherein the lamp cover has an outer surface area of at least 300 $mm^2$ per watt of the excitation light in order to provide faster heat transfer out of the lamp cover, and wherein the gap between the LED package and the lamp cover is at least 3 mm in order to reduce light entering the LED package from the lamp cover, thereby reducing absorption loss of light by the LED package.

* * * * *